United States Patent [19]

Gikow, deceased et al.

[11] 4,101,854

[45] Jul. 18, 1978

[54] TUNABLE HELICAL RESONATOR

[75] Inventors: Emanuel Gikow, deceased, late of Ocean, N.J., by Ida M. Gikow, executrix; Richard S. Tilton, Oceanport, N.J.

[73] Assignee: The United States of America as represented by the Secretary of the Army, Washington, D.C.

[21] Appl. No.: 763,384

[22] Filed: Jan. 28, 1977

[51] Int. Cl.[2] ..... H01P 7/04

[52] U.S. Cl. ..... 333/82 B; 333/73 R

[58] Field of Search ..... 333/70 S, 73 R, 73 C, 333/73 W, 82 R, 82 B, 83 R

[56] References Cited

U.S. PATENT DOCUMENTS

| | | | |
|---|---|---|---|
| 2,921,277 | 1/1960 | Goubau | 333/82 B X |
| 3,273,085 | 9/1966 | Ash et al. | 333/83 R |
| 3,581,249 | 5/1971 | Spangler et al. | 333/82 R X |

*Primary Examiner*—Paul L. Gensler

*Attorney, Agent, or Firm*—Nathan Edelberg; Arthur Boatright; Jeremiah G. Murray

[57] ABSTRACT

An RF tuneable resonator wherein RF energy is applied to a helical coil and the resonant frequency of the resonator is varied by utilizing a pair of axially moveable dielectric cylinders. One dielectric cylinder surrounds the helical coil and the other dielectric cylinder is positioned within the coil. Both dielectric cylinders are individually actuated along the axis of the coil.

12 Claims, 1 Drawing Figure

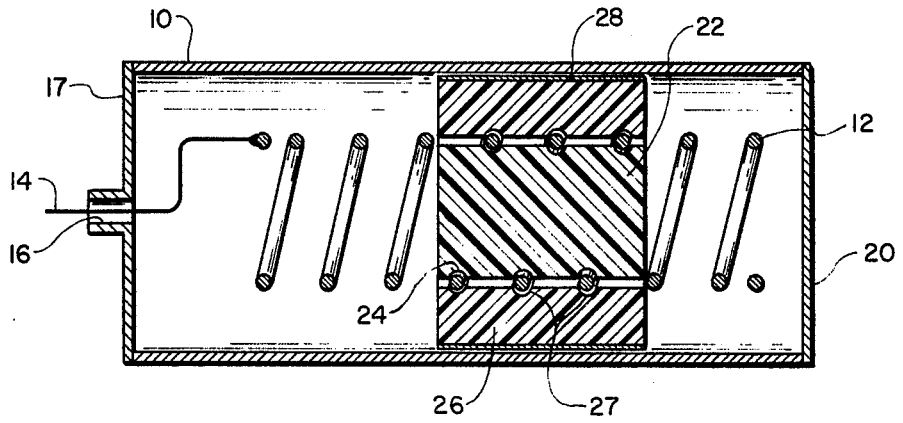
10
28
22
17
12
14
16
20
24
26
27

TUNABLE HELICAL RESONATOR

The invention described herein may be manufactured, used or licensed by or for the Government for governmental purposes without the payment of any royalty thereon.

BACKGROUND OF THE INVENTION

This invention relates to tuneable RF resonators and more particularly to helical coil resonators wherein tuning is achieved by dielectric loading of the inside and outside of the helical coil.

Tuneable helical resonators are very effective for use at radio frequencies of relatively high power. Such helical resonators are basically distributed parameter devices and provide extraordinary high unloaded Q's. This property leads to low loss since insertion loss, as a first order effect, is a function of the ratio of Q loaded/Q unloaded. Hence for a fixed bandwidth, the larger the Q unloaded, the lower the loss. However, it has been found that for this type of resonator, tuning becomes a problem since relatively large capacitors must be used in order to withstand the relatively large voltages.

SUMMARY OF THE INVENTION

It is an object of the present invention to provide an improved helical resonator having high tuning resolution over a relatively large tuning range.

In accordance with the present invention there is provided an RF helical resonator axially positioned within a cylindrical shield. Included is a first axially moveable dielectric means intermediate the shield and the helical coil and a second axially moveable dielectric means positioned within the helical coil. Tuning is accomplished by individually actuating both dielectrics along the axis of the coil.

BRIEF DESCRIPTION OF THE DRAWING

The single drawing illustrates in cross section the preferred embodiment of the present invention.

DESCRIPTION OF THE PREFERRED EMBODIMENT

Referring now to the drawing, at 10 there is shown a metallic cylinder or shield having a helical coil 12 axially positioned therein for propagating RF energy. The RF energy is fed to helix 12 by means of lead 14 which extends through a narrow opening 16 provided therefor in a disc 17 terminating one end of cylinder 10 and hereinafter referred to as the upper end. The other or lower end of cylinder 10 is terminated by end disc 20. As shown, helix 12 extends axially within cylinder 10 for substantially the entire length thereof, but the diameter of helix 12 is made slightly smaller than the diameter of cylinder 10. By such an arrangement, there is provided a radial space between helix 12 and the inner cylindrical surface of cylinder 10. Extending axially within helix 12 is an axially moveable solid dielectric cylinder 22, hereinafter referred to as the inner dielectric cylinder. The diameter of solid dielectric cylinder 22 is substantially equal to the inner diameter of helix 12 and the surface of solid dielectric cylinder 22 is preferably provided with a grooved helical channel as at 24 having an angular pitch corresponding to the pitch of helix 12. By such an arrangement, dielectric cylinder 22 may be axially positioned within helix 12 by rotating the dielectric cylinder 22 clockwise or counter clockwise. The mechanism for providing such rotation is well known in the art and no further description thereof is believed necessary. Extending axially in the radial space between helix 12 and the inner wall of cylinder 10 is dielectric cylinder 26 hereinafter referred to as the outer dielectric cylinder. Outer dielectric cylinder 26 thus encompasses helix 12 and its surface dimension extends radially from helix 12 to the inner surface of shield 10. The inner surface of cylindrical dielectric 26 is provided with a grooved helical channel as at 27 and having an angular pitch identical to that of the coils of helix 12 so that axial movement of outer dielectric cylinder 26 is provided by rotating it either clockwise or counter clockwise. For purposes of this invention, clockwise rotation of both inner dielectric cylinder 22 and outer dielectric cylinder 26 will actuate both dielectric cylinders axially towards disc 20 at the closed end of cylinder 10. A separate rotating mechanism is provided for outer dielectric cylinder 26 so that the inner and outer dielectric cylinders 22 and 26 may be individually positioned axially along helix 12. Since such mechanisms are well known in the art, no further description thereof is believed necessary. To reduce the radial air gaps between the outer surface of outer dielectric cylinder 26 and the inner wall of cylinder 10, the outer surface of dielectric cylinder 26 is metallized as shown at 28. If desired spring contacts may be provided between the inner wall of cylinder 10 and the metallized outer surface of dielectric cylinder 26 to further reduce the deleterious effect of radial air gaps. Both the outer and inner dielectric cylinders are approximately two-thirds the length of helix 12 and both dielectric cylinders are characterized by identical relatively high dielectric constants. In operation, tuning is accomplished by independently varying the relative axial positions of inner and outer dielectric cylinders 22 and 26, with respect to helix 12. Clockwise rotation of dielectric cylinders 22 and 26 will actuate the dielectric cylinders towards the closed end of cylinder 10 where the voltage gradient of helix 12 is a minimum. With both dielectric cylinders near the lower end of helix 12, the resonant frequency will be at a maximum. With the dielectric cylinders 22 and 26 at the upper end of helix 12, the resonant frequency will be a minimum. By independently varying both dielectric cylinders, the resonant frequency may be made to vary between these two ranges. With such dielectric loading of the inside and outside of helix 12, a large tuning range is achieved. The independent control of the dielectric cylinders allows for high tuning resolution. While both dielectric cylinders are shown with helically grooved channels to provide axial movement when rotated, it is to be understood that the invention is not to be limited thereto. For example, the grooved channels may be eliminated and axial movement may be achieved by merely sliding the dielectric cylinders longitudinally along helix 12.

What is claimed is:

1. A RF tuneable resonator comprising:

a metallic cylindrical shield;

a helical coil axially positioned within said metallic shield and including a RF coupling means at one end thereof;

a first axially moveable dielectric means intermediate said metallic shield and said helical coil; and a second axially moveable dielectric means positioned within said helical coil.

2. The tuneable resonator in accordance with claim 1 wherein said first dielectric means comprises a dielectric cylinder encompassing said helical coil.

3. The tuneable resonator in accordance with claim 1 wherein said second dielectric means comprises a solid dielectric cylinder.

4. The tuneable resonator in accordance with claim 2 wherein said second dielectric means comprises a solid dielectric cylinder.

5. The tuneable resonator in accordance with claim 4 wherein said encompassing dielectric cylinder extends radially from said coil to said shield and wherein the diameter of said solid dielectric cylinder is substantially equal to the inner diameter of said coil.

6. The tuneable resonator in accordance with claim 5 wherein the inner surface of said encompassing dielectric cylinder includes a helically grooved channel having a pitch corresponding to the pitch of said helical coil and engaging the outer surface thereof.

7. The tuneable resonator in accordance with claim 5 wherein said solid dielectric cylinder includes a helically grooved channel having a pitch corresponding to the pitch of said helical coil and engaging the inner surface thereof.

8. The tuneable resonator in accordance with claim 5 wherein the inner surface of said encompassing dielectric cylinder includes a helically grooved channel having a pitch corresponding to the pitch of said helical coil and engaging the outer surface of said coil and wherein said solid dielectric cylinder includes a helically grooved channel having a pitch corresponding to the pitch of said helical coil and engaging the inner surface thereof.

9. The tuneable resonator in accordance with claim 5 wherein the outer surface of said encompassing dielectric cylinder is metallized.

10. The tuneable resonator in accordance with claim 8 wherein the outer surface of said encompassing dielectric cylinder is metallized.

11. The tuneable resonator in accordance with claim 5 wherein both of said dielectric cylinders are substantially less than two-thirds the length of said helical coil, are moveable along the entire length of said coil and are characterized by relatively high dielectric constants.

12. The tuneable resonator in accordance with claim 4 wherein both of said dielectric cylinders are substantially less than two-thirds of the length of said helical coil, are moveable along the entire length of said coil and are characterized by relatively high dielectric constants.

* * * * *